United States Patent [19]

Sakamaki et al.

[11] Patent Number: 5,011,390

[45] **Date of Patent: * Apr. 30, 1991**

[54] ROTARY VANE MACHINE HAVING STOPPER ENGAGING RECESS IN VANE MEANS

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[ * ] Notice: The portion of the term of this patent subsequent to Apr. 17, 2007 has been disclaimed.

[21] Appl. No.: 394,777

[22] Filed: Aug. 16, 1989

Related U.S. Application Data

[60] Division of Ser. No. 197,548, May 23, 1988, Pat. No. 4,958,995, Continuation-in-part of Ser. No. 75,006, Jul. 17, 1987, abandoned, Continuation-in-part of Ser. No. 110,919, Oct. 21, 1987, abandoned, Continuation-in-part of Ser. No. 113,568, Oct. 26, 1987, abandoned, Continuation-in-part of Ser. No. 115,677, Oct. 31, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145[U] |
| Nov. 4, 1986 | [JP] | Japan | 61-168147[U] |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |

[51] Int. Cl.[5] ..... F01C 1/344; F16C 32/06

[52] U.S. Cl. ..... 418/256; 384/112; 384/113; 384/292; 384/901

[58] Field of Search ..... 418/256, 257, 265, 135; 384/112, 113, 115, 123, 292, 901

[56] References Cited

U.S. PATENT DOCUMENTS

| | | | |
|---|---|---|---|
| 2,414,187 | 1/1947 | Borsting | 418/256 |

FOREIGN PATENT DOCUMENTS

| | | | |
|---|---|---|---|
| 605595 | 2/1926 | France | 418/256 |
| 330884 | 6/1930 | United Kingdom | 418/265 |
| 421749 | 12/1934 | United Kingdom | 418/256 |

*Primary Examiner*—John J. Vrablik

*Attorney, Agent, or Firm*—Jordan and Hamburg

[57] ABSTRACT

A rotary machine for handling a fluid includes a housing having a rotor chamber and a rotor rotatably mounted in the rotor chamber. The rotor has a plurality of generally radially disposed vane slots and a plurality of vanes are slidably mounted in the vane slots and operable to define variable volume chambers as the rotor rotates and the vanes move generally radially in and out of the vane slots. Rotatable retainer plates are disposed between the housing and the longitudinal ends of the vanes, the retainer plates having stoppers extending axially into recesses in the vanes, the stoppers being operable to limit the extent of outward radial movement of the vanes to preclude sliding contact between the vanes and the inner peripheral surface of the rotor chamber.

21 Claims, 10 Drawing Sheets

ROTARY VANE MACHINE HAVING STOPPER ENGAGING RECESS IN VANE MEANS

RELATED APPLICATIONS

This is a division application of U.S. Ser. No. 197,548, filed May 23, 1988, U.S. Pat. No. 4,958,995, which is a continuation-in-part application of U.S. Ser. No. 075,006 filed July 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 12 has been heretofore widely known.

In FIG. 12, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To achieve the aforementioned objects, a vane pump according to the present invention is characterized in that projections such as pins are provided on both ends of a vane, and an annular race in peripheral slidable engagement with the projections to define the protrusion of the vane from a vane groove is formed coaxially with the inner peripheral surface of the housing.

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

A vane pump according the present invention is also designed so that retainer plates are disposed coaxially with the inner peripheral surface of a housing and rotatably internally of both end walls of the housing, and protrusion of a vane resulting from rotation is defined by stoppers projectingly provided on the ends in the outer periphery of both retainer plates.

According to the present invention, the vane which protrudes out of a vane groove by a centrifugal force resulting from rotation rotates in a state not in contact with the housing since both axial side ends at the end edges of the vane come into contact with stoppers. Since the retainer plates rotate along with the rotor and the vane, the relative sliding between the vane and the stoppers can be minimized.

As described above, in the vane pump of the present invention, protrusion of the vane is defined by the stoppers at the ends in the outer periphery of the retainer plates rotatably provided internally of both the end walls of the housing, and the vane is rotated in a state not in contact with the housing. Therefore, it is possible to minimize lowering of the pump efficiency due to sliding resistance and high heat generation caused by sliding and the advance of wear and to lower the temperature of fluids discharged from the pump.

The present invention further provides a vane pump comprising a rotor rotatably supported in eccentric fashion in an inner peripheral space of a housing, and plate-like vanes disposed capable of being projected and retracted into a plurality of vane grooves in the form of a depression in the rotor, wherein repeated variations in volumes of working spaces between the vanes are utilized to suck a fluid from one side and discharge it toward the other, characterized in that retainer plates coaxial with the inner peripheral spaces are rotatably fitted internally of the end wall of the housing, and the vanes and retainer plates are connected by cams to define the protrusion of the vanes from the vane grooves.

According to the present invention, the protrusion of the vanes from the vane grooves is not defined by the contact with the inner peripheral surface of the housing but it is defined so that the end edges of the vanes depict a given locus by engagement of the retainer plates fitted in the housing with the vanes through the cams. The vanes can be rotated in a state not in contact with the inner surface of the housing. Therefore, the present invention has excellent effects in that the lowering of the rotational efficiency and the wear of the vanes due to the sliding resistance can be prevented, and the occurrence of inconvenience such as the lowering of the volume efficiency due to the increase in heat generation caused by sliding can also be prevented.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

DESCRIPTION OF THE PREFERRED EMBODIMENTS

A fundamental exemplification of a vane pump according to the present invention will now be described with reference to FIGS. 1 to 3.

Figure 1:
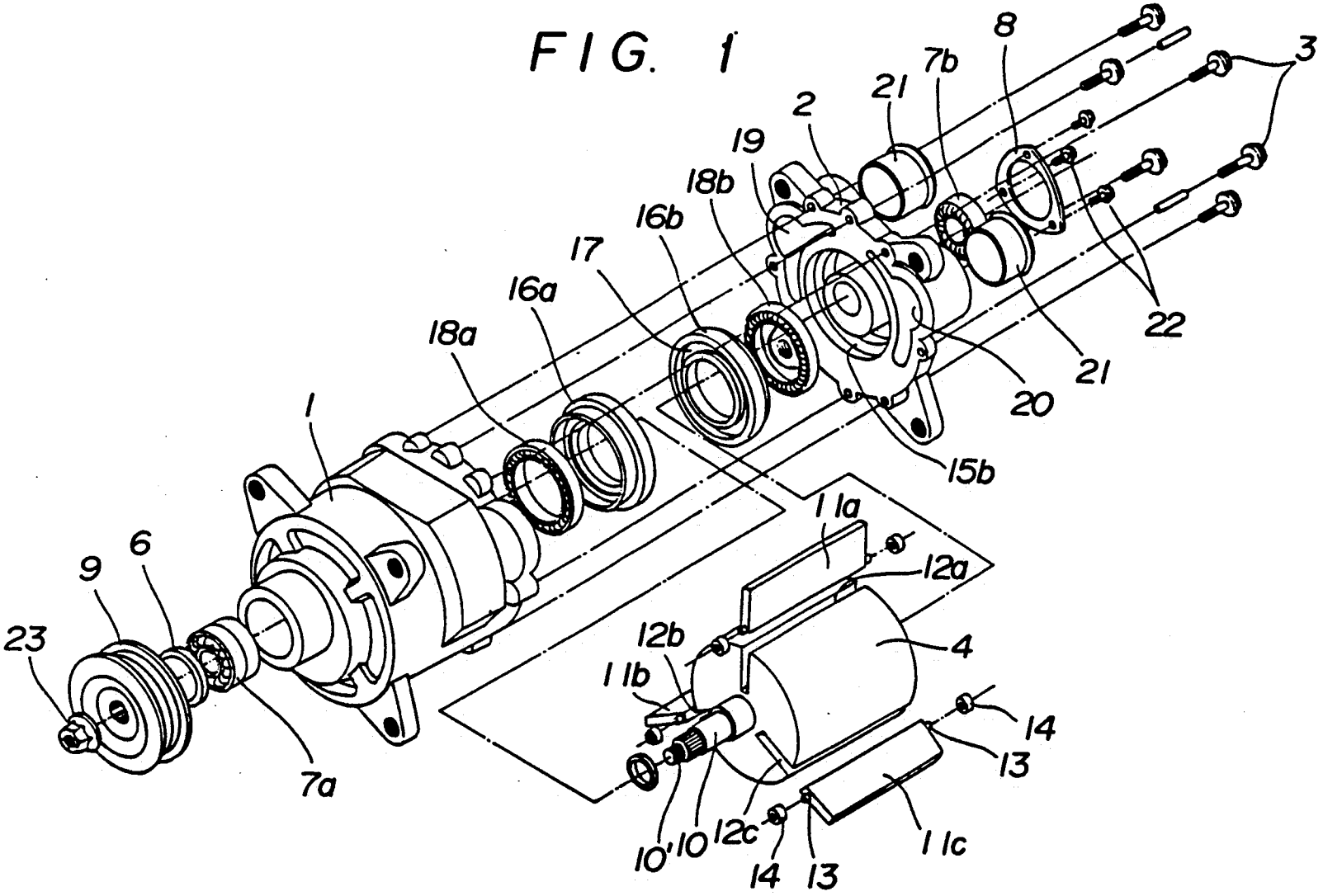
FIG. 1 is an exploded perspective view of a vane pump according to a fundamental embodiment of the present invention.
Figure 2:
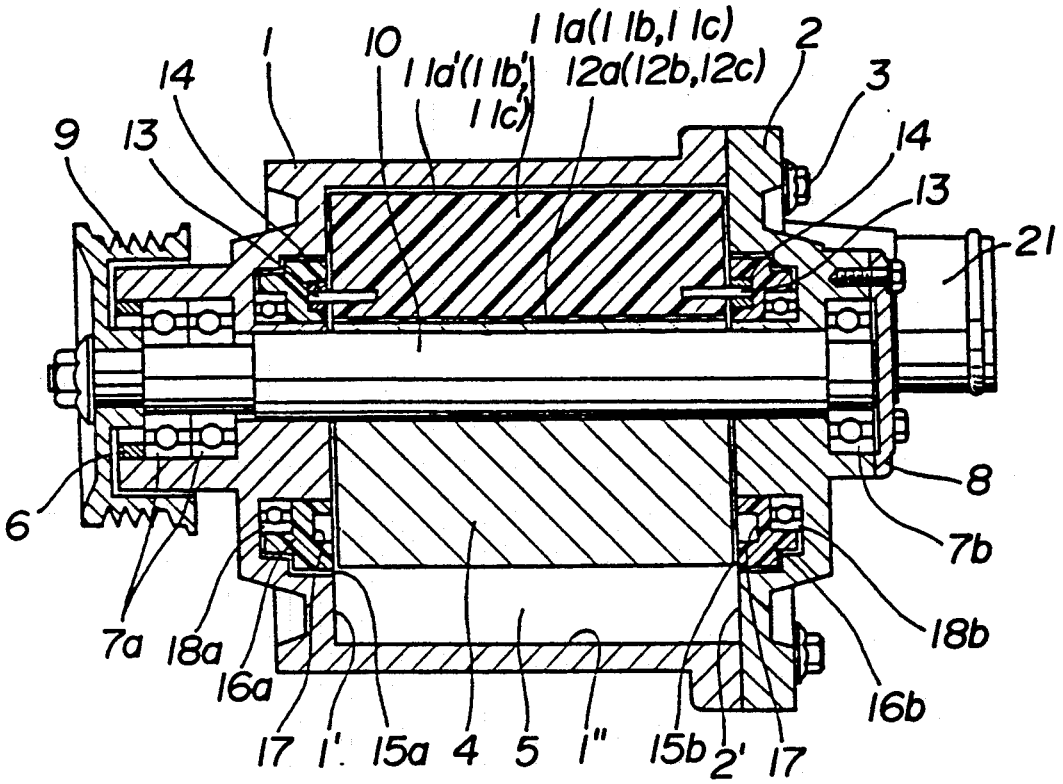
FIG. 2 is a sectional view showing the pump of FIG. 1 assembled.
Figure 3:
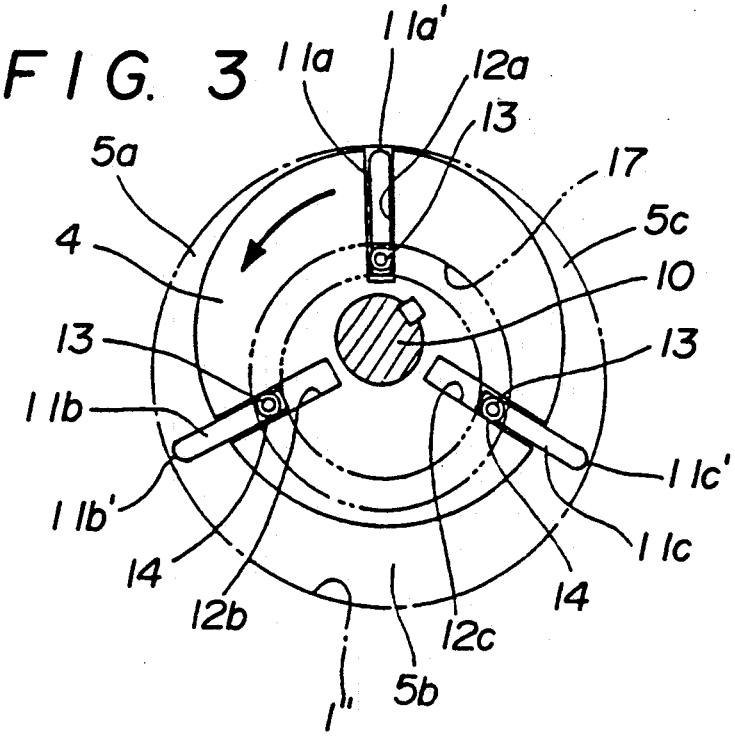
FIG. 3 is a side view of a rotor of the same pump of FIG. 1.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a'*, 11*b'* and 11*c'* (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a'*, 11*b'* and 11*c'* of the vanes 11*a*, 11*b* and 11*c* are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearing 18*a* and 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

A further embodiment of a vane pump according to the present invention will be described hereinafter with reference to FIGS. 4 to 10.

Figure 4:
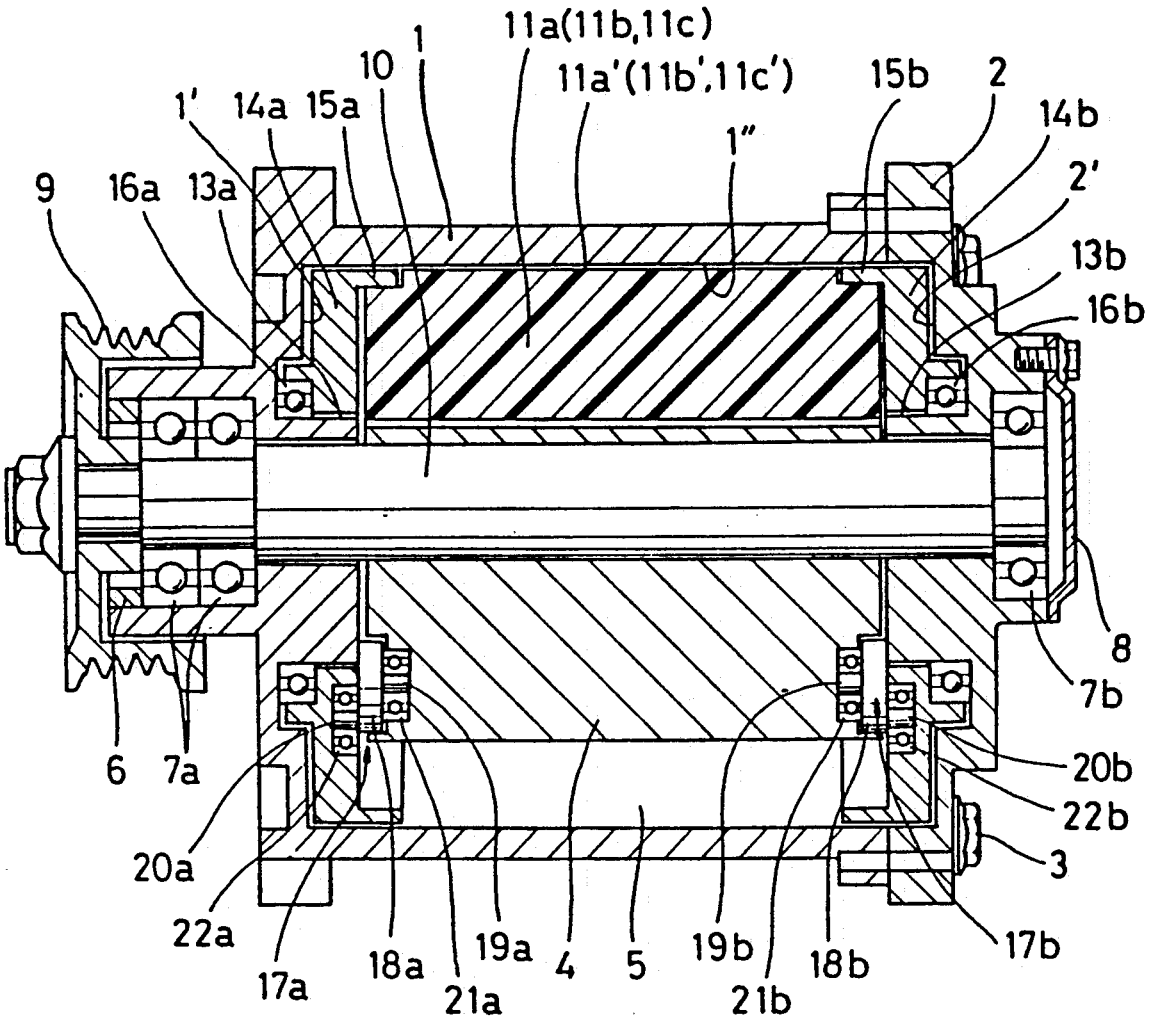
FIG. 4 is a sectional view of a vane pump according to another embodiment of the present invention.
Figure 5:
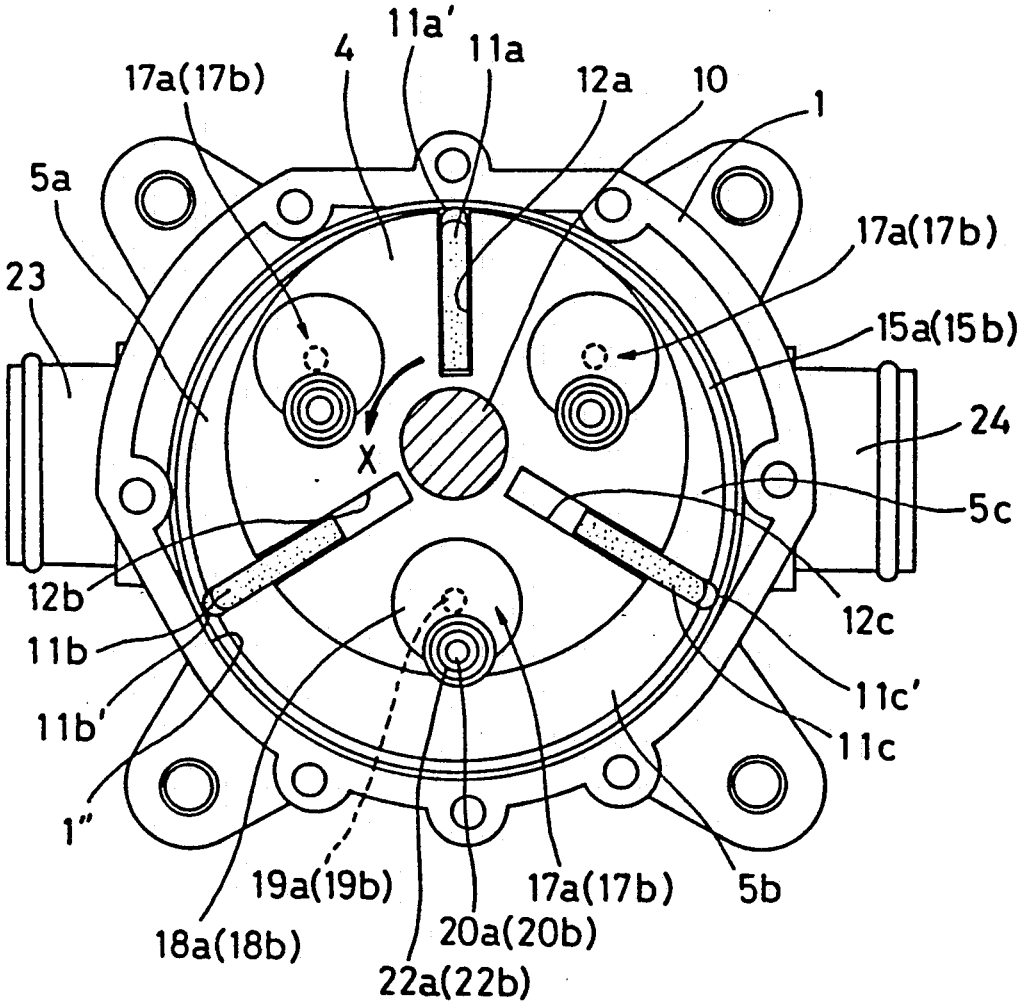
FIG. 5 is an explanatory view of an internal construction of the FIG. 4 pump viewed axially.

In FIGS. 4 and 5 showing another embodiment, a front housing 1 and a rear housing 2, which both housings are made of non-ferrous metal such as aluminum which is light in weight and is small in coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. In inner surfaces 1' and 2' opposed to each other of end walls of the front housing 1 and rear housing 2 are provided peripheral shoulders 13*a* and 13*b* formed coaxial with the inner peripheral space 5 of the housing (coaxial with the inner peripheral surface 1'' of the front housing 1). Retainer plates 14*a* and 14*b* formed of non-ferrous metal such as aluminum and having a diameter slightly smaller than the inner peripheral surface 1'' of the housing are rotatably mounted .on the peripheral shoulders 13*a* and 13*b* through ball bearings 16*a* and 16*b*. On the outer peripheral ends of the retainer plates 14*a* and 14*b* are formed annular stoppers 15*a* and 15*b* projected parallel to the axis and adapted to define the protrusion of the vanes 11*a*, 11*b* and 11*c*. Reference numeral 17*a* designates a cam whereby the rotor 4 and the retainer plate 14*a* are rotatably connected between opposed ends thereof and is constructed such that a pin 19*a* rotatably axially inserted in a position where one end of the rotor 4 is peripherally equally divided into three sections through a ball bearing 21*a* is secured in the central portion of one side of each disk 18*a*, and a pin 20*a* rotatably axially inserted in a position where the retainer plate 14*a* is peripherally equally divided into three sections through a ball bearing 22*a* is secured to the outer end of the other side of each disk 18*a*. Reference numeral 17*b* designates a cam whereby the rotor 4 and the retainer plate 14*a* are rotatably connected between opposed ends thereof and is constructed such that a pin 19*b* rotatably axially inserted in a position where the other end of the rotor 4 is peripherally equally divided into three sections through a ball bearing 21*b* is secured in the central portion of one end of each disk 18*b*, and a pin 20*b* rotatably axially inserted in a position where the retainer plate 14*b* is peripherally equally divided into three sections through a ball bearing 22*b* is secured to the outer end of the other side of each disk 18*b*. The pins 19*a*, 19*b* and pins 20*a*, 20*b* are on the circumference of the same diameter eccentric to each other by an eccentric amount of the rotor 4. The retainer plates 14*a*, 14*b* are rotated in synchronism with the rotor 4 by the cams 17*a*, 17*b*. Reference numeral 23 designates an intake port for introducing a fluid from the outside into the inner peripheral space 5 of the housing, and reference numeral 24 designates a discharge port for introducing a fluid from the inner peripheral space 5 of the housing toward the outside.

Next, the operation of the aforementioned vane pump will be described. When the rotational shaft 10 and the rotor 4 are rotated in the direction as indicated at X by the drive force from the pulley 9, the vanes 11*a*, 11*b* and 11*c* also rotate. Here, the protrusion the vanes 11*a*, 11*b* and 11*c* caused by the centrifugal force resulting from the aforesaid rotation is defined by the contact between the rotor 4 and the stoppers 15*a* and 15*b* on the outer peripheral ends of the retainer plates 14*a* and 14*b*, and accordingly, the vanes 11*a*, 11*b* and 11*c* rotate in a state leaving a slight clearance (in a non-contact state) between the vanes and the inner peripheral surface 1'' of the housing and are in a state not in contact with both the inner surfaces 1' and 2' of the housing with the provision of the retainer plates 14*a* and 14*b*. Since the inner peripheral surface 1'' and the stoppers 15*a*, 15*b* are in a relation of being coaxial with each other and the stoppers 15*a*, 15*b* and the rotor 4 are in a relation of being eccentric with each other, the vanes 11*a*, 11*b* and 11*c* are radially slidably moved in the vane grooves 12*a*, 12*b* and 12*c* of the rotor 4 and repeatedly projected and withdrawn. As the result, the volume of the working spaces 5*a*, 5*b* and 5*c* defined by the housings 1, 2, the rotor 4 and the vanes 11*a*, 11*b* and 11*c* is repeatedly increased and decreased. That is, FIG. 5 shows the process in which the working space 5*a* increases its volume as the rotation takes place and sucks the fluid from the intake port 23 open to portion 5*a*; the working space 5*c* decreases its volume as the rotation takes place and discharges the fluid into the discharge port 24 open to portion 5*c*; and the working space 5*b* transfers the sucked fluid toward the discharge port 24.

In the above-described operation, the vanes 11*a*, 11*b* and 11*c* are totally free from sliding contact with the inner peripheral surface 1'' of the housing and both the inner surfaces 1' and 2', and the end edges 11*a'*, 11*b'* and 11*c'* of the vanes come into sliding contact with the stoppers 15*a*, 15*b* of the retainer plates 14*a*, 14*b* only at their both axial side ends. However, since the stoppers 15*a*, 15*b* are rotated in synchronism with the rotor 4, the aforesaid sliding amount is small and thus the lowering of the efficiency and the advance of the wear resulting from sliding resistance and sliding heat generation can be minimized, and the temperature of the fluid discharged from the discharge port 24 can be lowered. In addition, according to the aforementioned arrangement, since the stoppers 15*a*, 15*b* which define the protrusion of the vanes 11*a*, 11*b* and 11*c* are very close to the inner peripheral surface 1'' of the housing, the locus of the end edges 11*a'*, 11*b'* and 11*c'* of the vanes is approximately circular in shape, despite the repeated change of the relative angle between the vanes 11*a*, 11*b* and 11*c* and the inner peripheral surface 1'' of the housing, and the vanes rotate always leaving a given fine clearance (in a state not in contact) relative to the inner peripheral surface 1'' of the housing. While in the above-described embodiment, the cam is used to rotate the retainer plates in synchronism with the rotor, it is noted that similar effects may be obtained by an arrangement wherein the retainer plates are rotated approximately in synchronism with the rotor by the frictional force between the vanes and the stoppers. In addition, while in the above-described embodiment, the stoppers are annularly formed, it is noted that in the case where the retainer plates are rotated in synchronism with the rotor by the cam, portions of the stoppers in contact with the vanes are restricted, and therefore the stoppers can be formed in the form of an arc corresponding to those portions.

Figure 6:
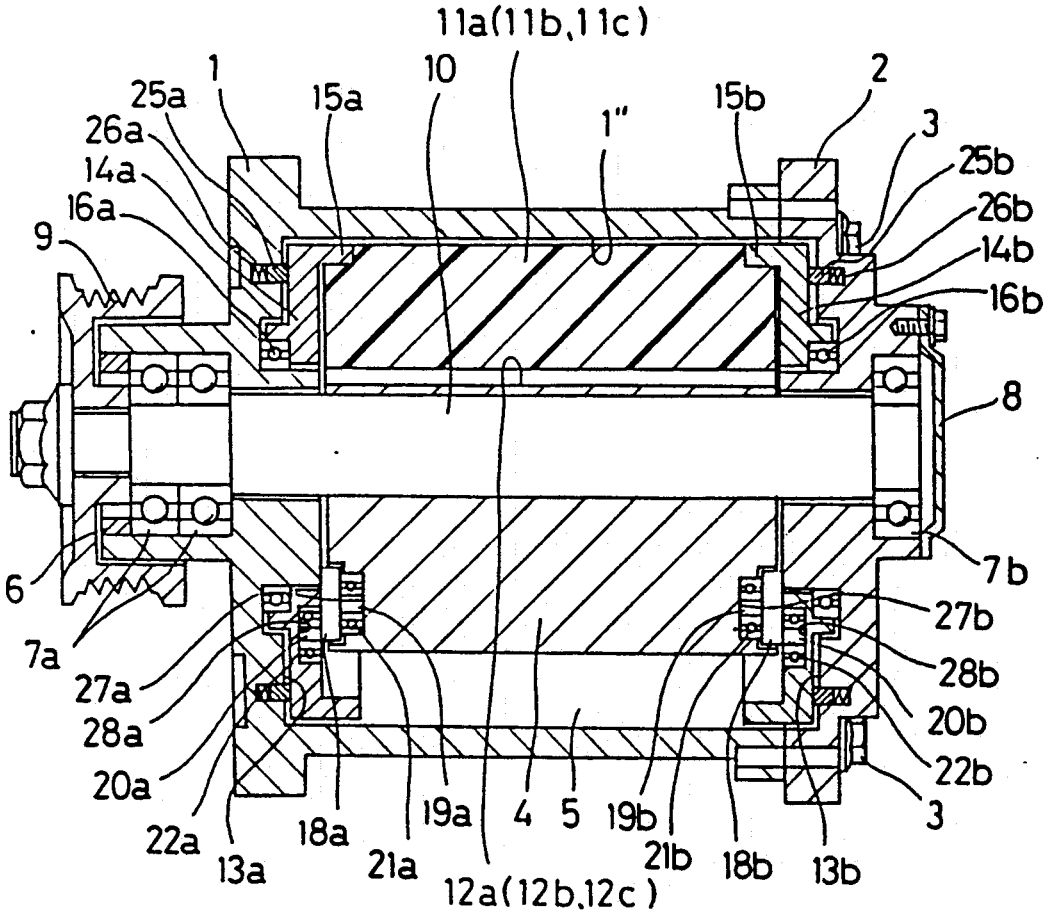
FIG. 6 is a sectional view of a vane pump according to a further embodiment of the present invention.

Next, a further embodiment of the present invention will be described with reference to FIG. 6. The second embodiment is, in addition to the features of the pump according to the first embodiment, characterized in that back-up rings 25*a* and 25*b* for restraining a deflection of the retainer plates are interposed between the retainer plates and the end wall of the housing. The vanes 11*a*, 11*b* and 11*c* are supported on the retainer plates 14*a* and 14*b* by contact of the vanes with the stoppers 15*a* and 15*b* as previously described. To provide the smooth projection and retraction of the vanes 11*a*, 11*b* and 11*c*, the retainer plates 14*a* and 14*b* must be firmly supported and smoothly rotated in order not to oscillate the retainer plates 14*a* and 14*b*. Practically, however, the ball bearings 16*a* and 16*b* oscillate in the thrust direction, and the retainer plates 14*a* and 14*b* oscillate due to the pressure distribution within the working space 5 into contact with the end walls of the housings 1 and 2, resulting in a deviation or an inclination of the vanes 11*a*, 11*b* and 11*c*. The present pump takes this into consideration beforehand, and the backup rings 25*a* and 25*b* are interposed between the retainer plates 14*a* and 14*b* and the end walls of the housings 1 and 2 to prevent the oscillation of the retainer plates 14*a* and 14*b*. The backup rings 25*a* and 25*b* made of non-lubrication sliding material such as carbon and resin are fitted in the annular grooves positioned partly of the peripheral shoulders 13*a* and 13*b*, and the ends thereof are brought into contact with the back of the retainer plates 14*a* and 14*b*. In addition, a number of coil springs 26*a* and 26*b* are provided as needed to strengthen the supporting force, thus preventing the oscillation of the retainer plates 14*a* and 14*b* to prevent the retainer plates 14*a* and 14*b* from contacting the end wall of the housing to indirectly secure the smooth operation of the vanes 11*a*, 11*b* and 11*c*. In this pump, the cams 17*a* and 17*b* may be removed to simplify the construction; and when a dynamic pressure bearing such as a spiral groove, a herringbone groove, etc. is provided in a contact surface between the retainer plates 14*a*, 14*b* and the backup rings 25*a*, 25*b*, the sliding resistance of this portion can be reduced to make the rotation of the retainer rings 14*a* and 14*b* smooth. Reference numerals 27*a*, 27*b*, 28*a* and 28*b* designate recesses for receiving the cams 17*a*, 17*b*, and bearings 21*a*, 21*b*, 22*a* and 22*b*.

Figure 7:
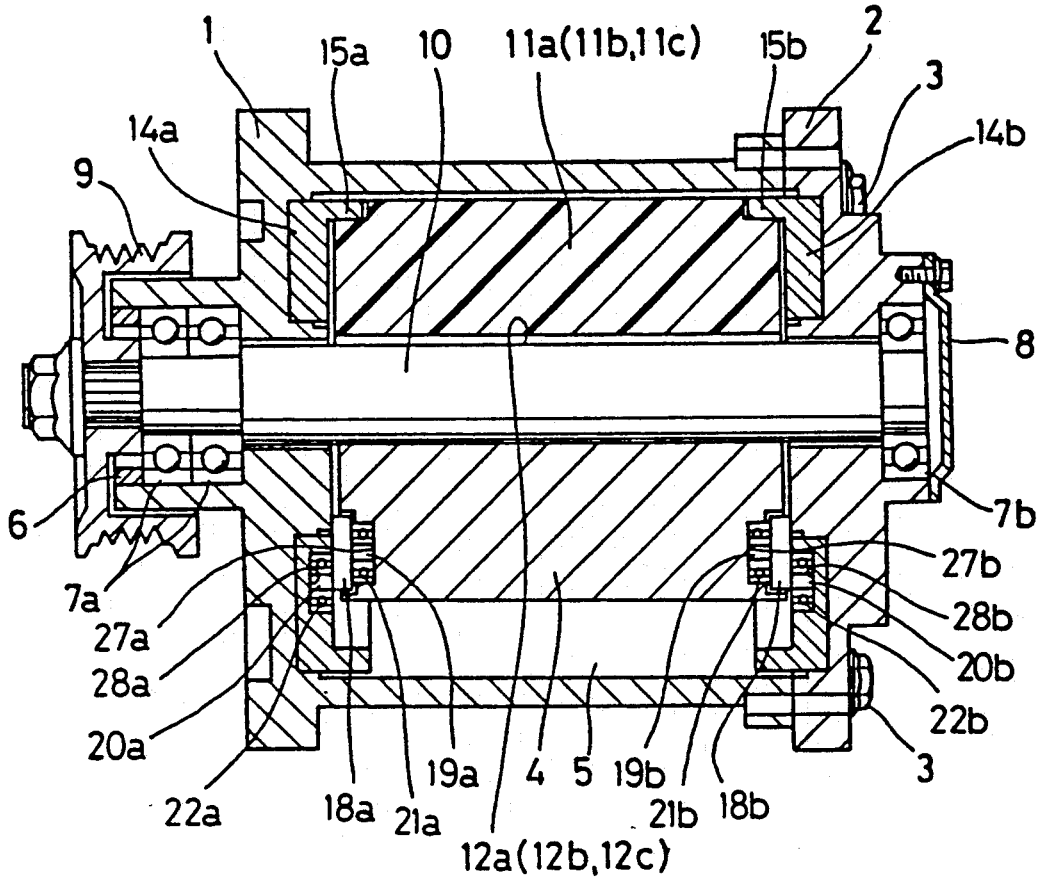
FIG. 7 is a sectional view of a vane pump according to still another embodiment of the present invention.
Figure 8:
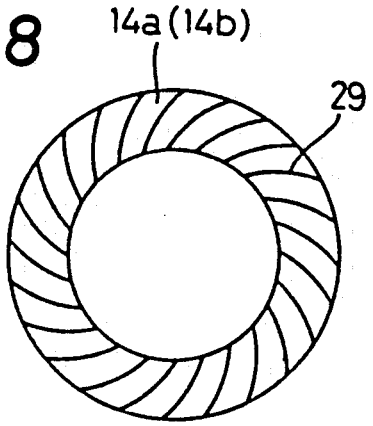
FIG. 8 is a front view of a retainer plate.

In the following, a third embodiment of the present invention will be described with reference to FIG. 7. In the pump according to the first embodiment, the retainer plates 14*a* and 14*b* have been supported by the bearings 16*a* and 16*b*. However, in the pump according to the third embodiment, the bearings 16*a* and 16*b* are removed. The pump of the third embodiment is characterized in that the retainer plates 14*a* and 14*b* are directly supported on the housings 1 and 2, and dynamic pressure bearing mechanisms are provided on the end surfaces or the peripheral surfaces of the retainer plates 14*a* and 14*b* to reduce the number of parts. This dynamic pressure bearing mechanism is composed of a groove capable of producing dynamic pressure such as a spiral groove, a Rayleigh step groove, a herringbone groove, etc. formed on the end surfaces or peripheral surfaces of the retainer plates 14*a* and 14*b*, or a recess or a combination of groove and recess to minimize the sliding resistance resulting from rotation of the retainer plates 14*a* and 14*b*. FIG. 8 shows, as one example of this dynamic pressure bearing mechanism, a spiral groove 29 provided in the outer end surface of the retainer plates 14*a* and 14*b*. Also in this pump, the cams 17*a* and 17*b* can be removed to simplify the construction.

Figure 9:
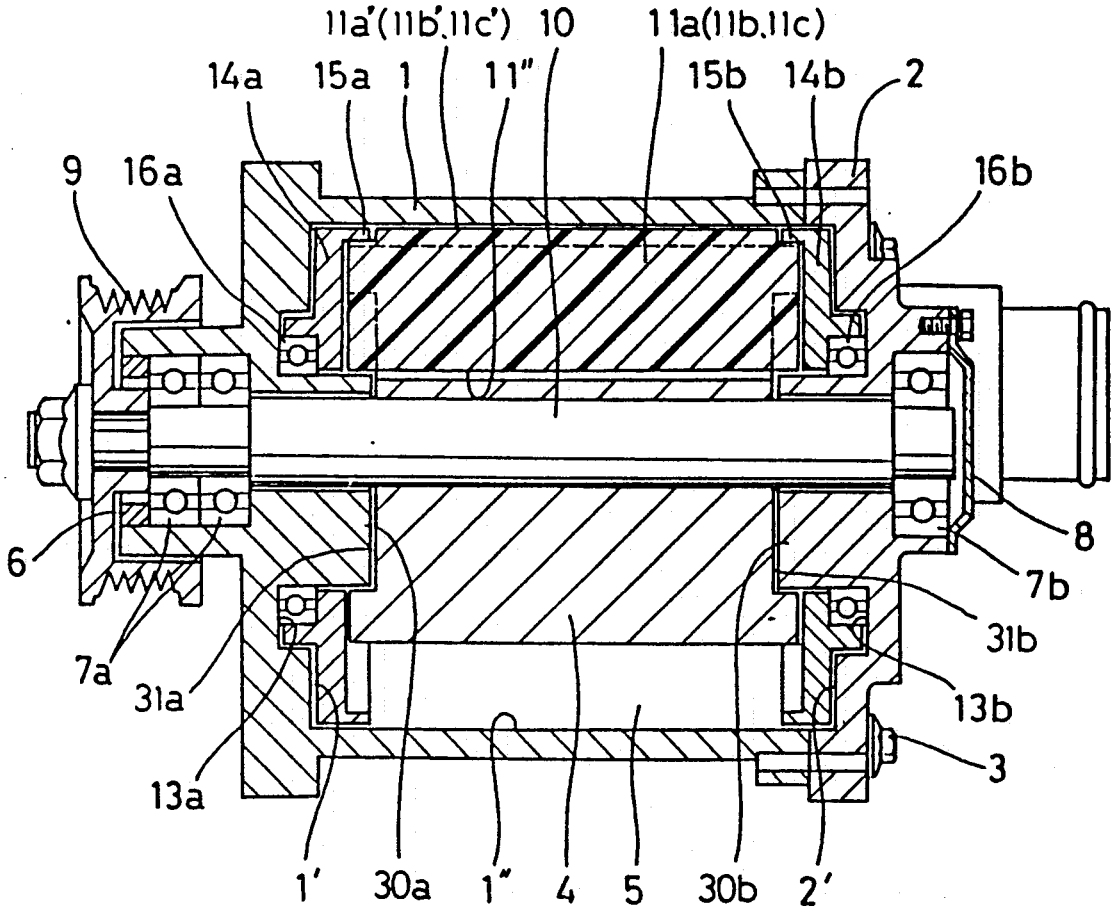
FIG. 9 is a sectional view of a vane pump according to yet another embodiment of the present invention.
Figure 10:
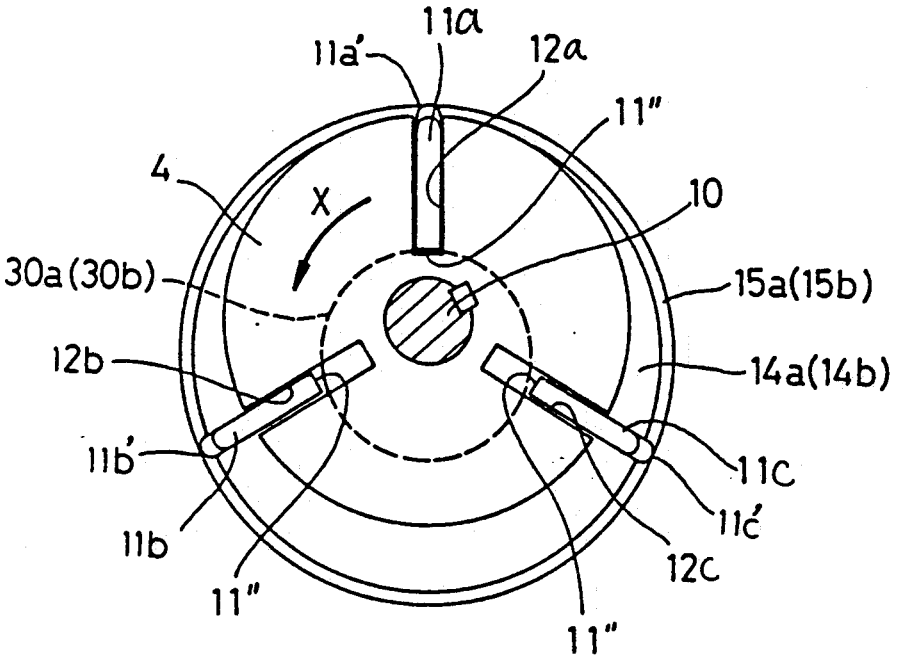
FIG. 10 is an explanatory view of an internal construction of the FIG. 9 pump as viewed axially.

Being common to the above-described respective embodiments, when the rotor 4 stops, some vanes 11*a*, 11*b* and 11*c* withdraw toward the bottom of the vane grooves 12*a*, 12*b* and 12*c* due to their own weight according to their angular position. With the aforesaid withdrawal the vanes 11*a*, 11*b* and 11*c* rapidly protrude at the time of start, and as the result the end edges 11*a*', 11*b*' and 11*c*' of the vanes impinge upon the stoppers 15*a* and 15*b*, thus resulting in a possible breakage of the vanes 11*a*, 11*b* and 11*c* and the stoppers 15*a* and 15*b*. To prevent this, the fourth embodiment of the present invention is characterized in that internally of both end walls of the housing, small-diameter bosses are projectingly provided coaxial with the inner peripheral surface of the housing to define the withdrawal of the vanes into the vane grooves. FIGS. 9 and 10 show an arrangement wherein such a construction is incorporated on the basis of the pump according to the first embodiment. More specifically, bosses 30*a* and 30*b* coaxial with the inner peripheral surface 1" of the housing are projectingly provided on the internal surfaces 1' and 2' of the housings 1 and 2, and the bosses 30*a* and 30*b* are positioned in recesses 31*a* and 31*b* formed in both end surfaces of the rotor 4 so as to support the inner end edge 11' of each of the vanes 11*a*, 11*b* and 11*c* from the inner peripheral side. Thereby, when the rotor 4 stops, some of the vanes 11*a*, 11*b* and 11*c* tend to withdraw toward the bottom of the vane grooves 12*a*, 12*b* and 12*c* due to their own weight according to their angular position. However, the aforesaid withdrawal is defined by the impingement of the inner end edge 11" of the vanes upon the outer peripheral surface of the bosses 30*a* and 30*b*. Thus, it is possible to avoid an excessive impact between the end edges 11*a*', 11*b*' and 11*c*' of the vanes and the stoppers 15*a* and 15*b* due to the rapid protrusion of the vanes 11*a*, 11*b* and 11*c* at the time of start.

As described above, according to the present embodiments, the hydrodynamic loss is overcome. In addition, since it is designed so that the vanes 8 rotate in non-contact with the inner peripheral surface 1" of the housing 1, the loss caused by mechanical friction is also extremely reduced, and very high efficiency may be obtained.

Figure 11:
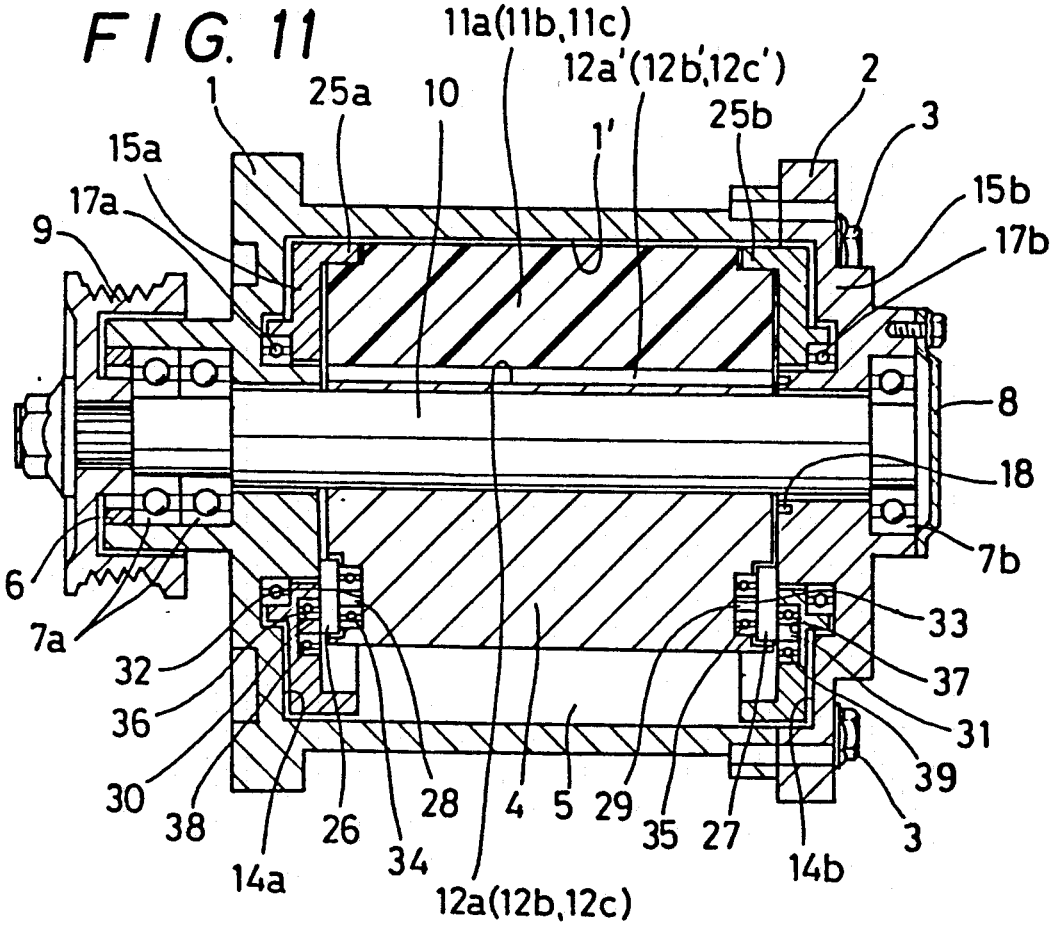
FIG. 11 is a sectional view of a vane pump according to still another embodiment of the present invention.
Figure 12:
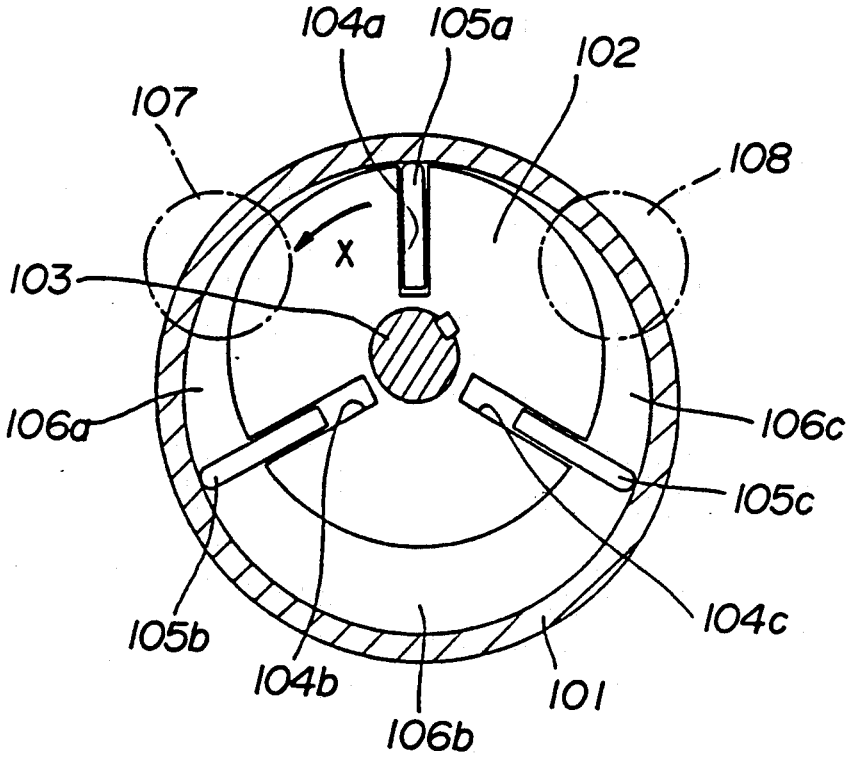
FIG. 12 PRIOR ART
FIG. 12 is a sectional view showing one example of a vane pump according to the prior art.

FIG. 11 shows a further embodiment of the present invention. Stoppers 25*a* and 25*b* projected parallel to the axis are formed on the outer peripheral ends of retainer plates 15*a* and 15*b* to define the protrusion of the vanes 11*a*, 11*b* and 11*c*. Reference numerals 26 and 27 designate cams for rotatively connecting the rotor 4 and the retainer plates 15*a* and 15*b* between the opposite ends thereof, the cams being disposed three in number in equally spaced relation on one side of the rotor 4. The cams 26 and 27 fitted in recesses 32 and 33 formed in equally spaced relation on the end of the rotor 4 have first pins 28 and 29 extended to engage the rotor 4 at the center of one surface (inner surface) of a circular disk and are rotatably mounted on the rotor 4 through ball bearings 34 and 35. The cams further have second pins 30 and 31 extended to engage the retainer plates 15*a* and 15*b* in the vicinity of the peripheral edge of the other surface (outer surface) of the rotary disk and are rotatably engaged through ball bearings 38 and 39 with recesses 36 and 37 formed in the retainer plates 15*a* and 15*b*. The first pins 28 and 29 and the second pins 30 and 31 are on the circumferences of the same diameter eccentrically with each other through an eccentric amount of the rotor 4, and the retainer plates 15*a* and 15*b* are rotated in synchronism with the rotor 4 by the cams 26 and 27. This pump also defines the protrusion of the vanes 11*a*, 11*b* and 11*c* by the action of the stoppers 25*a* and 25*b* to maintain the vanes 11*a*, 11*b* and 11*c* not in contact with the housing 1. Further, the cams 26 and 27 are used to provide synchronous rotation between the rotor 4 and the retainer plates 15*a* and 15*b*, thus making it possible to suppress the loss of torque resulting from the rotation to prevent inconveniences such as wear, generation of heat and the like. It is to be noted that in the pump, the cams 26 and 27 may be removed to simplify the construction, and in addition, the boss described in connection with the above-described second embodiment may be added, and means for defining the movement of the vanes 11*a*, 11*b* and 11*c* may be used.

As means for defining the amount of protrusion of the vanes 11*a*, 11*b* and 11*c*, it is contemplated that in addition to the above, the aforesaid cams 26 and 27 are used to engage the vanes 11*a*, 11*b* and 11*c* with the retainer plates 15*a* and 15*b* for connection therebetween.

In the inner surface of the end wall of the rear housing 2, an annular back pressure regulating groove 18 is formed coaxially with the rotational shaft 10 on the inside diameter side of the annular recess 14*b* so that bottoms 12*a*', 12*b*', and 12*c*' of vane grooves 12*a*, 12*b* and 12*c*, respectively, positioned in the back surface (inner end side) of the vanes 11*a*, 11*b* and 11*c*, communicate with one another as shown in FIG. 11.

As regards the bottoms 12*a*', 12*b*', and 12*c*' of the vane grooves 12*a*, 12*b* and 12*c*, the volumes of the vane grooves at the bottoms 12*a*', 12*b*' and 12*c*' are repeatedly increased and decreased by the projection and retraction of the vanes 11*a*, 11*b* and 11*c* caused by the rotation of the rotor 4. The internal pressure of the bottoms 12*a*', 12*b*' and 12*c*' act as back pressure on the vanes 11*a*, 11*b* and 11*c* to increase and decrease according to the aforesaid volumes.

Taking this into consideration, the present pump is provided with the back pressure regulating groove 18 so that the internal pressure of the vane groove bottoms 12*a*', 12*b*' and 12*c*' may be regulated. The back pressure regulating groove 18 is annularly formed to be coaxial with the rotational shaft 10 in the inner surface of the end wall of the rear housing 2 as previously mentioned to communicate the vane groove bottoms 12*a*', 12*b*' and 12*c*' with one another. That is, paying attention to the fact that a period of increase and decrease in volumes of the vane groove bottoms 12*a*', 12*b*' and 12*c*' is deviated and the sum of the volumes of the three bottoms 12*a*', 12*b*' and 12*c*' is always approximately equal, the back pressure regulating groove 18 transfers a part of the pressure from the bottom 12*c*' in the pressure increasing process to the bottom 12*b*' in the pressure decreasing process to always balance the aforesaid pressure so as not to induce an excessive increase or decrease in pressure to the bottoms 12*a*', 12*b*' and 12*c*'.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987.

What we claim is:

1. A rotary machine for handling a fluid comprising a housing means having a rotor chamber, said rotor chamber having an inner peripheral surface, a rotor means rotatably mounted in said rotor chamber, said rotor means having an axis of rotation, said inner peripheral surface having an axis which is eccentric relative to said axis of rotation of said rotor means, said rotor means having a plurality of generally radially disposed vane slots, a plurality of vanes slidably mounted in said vane slots and operable to define variable volume chambers as said rotor means rotates and said vanes move generally radially in and out of said vane slots, said vanes having longitudinal ends and outer radial ends, recesses in said vanes opening up onto said longitudinal ends and opening up onto said outer radial ends, said recesses having recess walls having a thickness corresponding to the thickness of said vanes, one of said recess walls being an inner recess wall which extends generally parallel to said axis of rotation of said rotor means, retainer plate means disposed between said housing means and said longitudinal ends of said vanes, rotatable support means rotatably supporting said retainer plate means from said housing means, said retainer plate means having stopper means extending axially into said recesses in said vanes, said stopper means having an annular engageable surface, said annular engageable surface being engaged by said inner recess wall to limit the extent of outward radial movement of said vanes to preclude sliding contact between said vanes and said inner peripheral surface of said rotor chamber, said annular engageable surface having a center coincident with said central axis of said inner peripheral surface of said rotor chamber.

2. A rotary machine according to claim 1, wherein said housing means has end walls perpendicular to said central axis, said end walls defining the longitudinal ends of said rotor chamber, said retainer plate means being disposed between said housing end walls and said longitudinal ends of said vanes, said housing end walls having an end wall recess, said retainer plate means having an axial projection extending into said end wall recess, bearing means in said end wall recess for rotatably supporting said retainer plate means, said retainer plate means being spaced from said housing end walls and from said inner peripheral surface of said rotor chamber.

3. A rotary machine according to claim 1, wherein said retainer plate means has an outer radial end, said axial stoppers extending axially from said outer radial ends.

4. A rotary machine according to claim 1, wherein said rotatable support means comprises bearing means rotatably supporting said retainer plate means on said housing means.

5. A rotary machine according to claim 1, further comprising operable means operably disposed between said retainer plate means and said rotor means for effecting rotation of said retainer plate means in synchronism with said rotor means.

6. A rotary machine according to claim 3, wherein said operable means comprises disks rotatably mounted between said retainer plate means and said rotor means, said disks having one pin rotatably mounted on said retainer plate means and another pin rotatably mounted on said rotor means.

7. A rotary machine according to claim 1, wherein said housing means has a rotor chamber end wall perpendicular to said central axis, said retainer plate means being disposed between said rotor chamber end wall and the longitudinal end of said vanes, and preventer means projecting from said rotor chamber end wall and engageable with said retainer plate means for precluding contact between said retainer plate means and said rotor chamber end wall.

8. A rotary machine according to claim 7, further comprising receiving opening means in said rotor chamber end wall for receiving and mounting said preventer means.

9. A rotary machine according to claim 7, wherein said preventer means comprises biasing means to provide biasing contact between said preventer means and said retainer plate means.

10. A rotary machine according to claim 7, wherein said preventer means comprises a backup ring means engageable with said retainer plate means.

11. A rotary machine according to claim 10, wherein said preventer means comprises biasing means biasing said backup ring means into biasing contact with said retainer plate means.

12. A rotary machine according to claim 10, wherein said backup ring means is made of a carbon material.

13. A rotary machine according to claim 10, wherein said backup ring means is made of a resin material.

14. A rotary machine according to claim 1, wherein said rotatable support means for rotatably supporting said retainer plate means comprises dynamic pressure-producing grooves formed in said retainer plate means and operable to provide a layer of said fluid between said retainer plate means and said housing means to thereby minimize the frictional rotational resistance of said retainer plate means as said retainer plate means rotates with said rotor means in said housing means.

15. A rotary machine according to claim 1, wherein said housing means has a rotor chamber end wall perpendicular to said central axis, said retainer plate means being disposed between said rotor chamber end wall and the longitudinal ends of said vanes, said retainer plate means having an end face perpendicular to said central axis, and dynamic pressure-producing groove means formed in said end face and operable to provide a layer of said fluid between said end face and said end wall to thereby minimize the frictional rotational resistance of said retainer plate means as said retainer plate means rotates with said rotor means in said housing means.

16. A rotary machine according to claim 1, wherein said housing means comprises boss means engageable with said vanes to prevent said vanes from sliding radially into said vane slots when said rotor means is not rotating.

17. A rotary machine according to claim 1, wherein said stopper means have an outer radial end wall, said vanes having an outer radial end wall axially aligned with said outer radial end wall of said stopper means.

18. A rotary machine according to claim 1, wherein said vane slots in said rotor means have a constant thickness throughout their axial and radial lengths, said inner recess wall having a thickness substantially equal to the thickness of said vane slots.

19. A rotary machine according to claim 1, wherein said retainer plate means is made of a non-ferrous material.

20. A rotary machine according to claim 1, wherein said retainer plate means is made of aluminum.

21. A rotary machine for handling a fluid comprising a housing means having a rotor chamber, said rotor chamber having an inner peripheral surface, a rotor means rotatably mounted in said rotor chamber, said rotor means having an axis of rotation, said inner peripheral surface having an axis which is eccentric relative to said axis of rotation of said rotor means, said rotor means having a plurality of generally radially disposed vane slots, a plurality of vanes slidably mounted in said vane slots and operable to define variable volume chambers as said rotor means rotates and said vanes move generally radially in and out of said vane slots, said vanes having longitudinal ends and outer radial ends intersecting at vane corners, recesses at said vane corners opening up onto said longitudinal ends and opening up onto said outer radial ends, said recesses having recess walls having a thickness corresponding to the thickness of said vanes, one of said recess walls being an inner recess wall which extends generally parallel to said axis of rotation of said rotor means, retainer plate means disposed between said housing means and said longitudinal ends of said vanes, rotatable support means on said housing means for rotatably supporting said retainer plate means from said housing means, said retainer plate means having an outer radial end, stopper means extending axially from said outer radial end into said recesses in said vanes, said stopper means having an annular engageable surface, said annular engageable surface being engaged by said inner recess wall to limit the extent of outward radial movement of said vanes to preclude sliding contact between said vanes and said inner peripheral surface of said rotor chamber, said annular engageable surface having a center coincident with said central axis of said inner peripheral surface of said rotor chamber.

* * * * *